US006220470B1

(12) United States Patent
McHenry et al.

(10) Patent No.: US 6,220,470 B1
(45) **Date of Patent: *Apr. 24, 2001**

(54) RESEALABLE CLOSURE FOR OPEN END OF CONTAINER

(75) Inventors: Robert J. McHenry, St. Charles; Thomas T. Tung, Barrington; Colleen M. Schwingel, Chicago, all of IL (US)

(73) Assignee: American National Can Company, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/953,067

(22) Filed: Oct. 20, 1997

(51) Int. Cl.[7] ..... B65D 51/18
(52) U.S. Cl. ..... 220/254; 220/821; 220/824
(58) Field of Search ..... 220/254, 269, 220/821, 824

(56) References Cited

U.S. PATENT DOCUMENTS

| | | | | |
|---|---|---|---|---|
| 2,105,445 | | 1/1938 | Sebell . | |
| 2,173,571 | | 9/1939 | Jesnig . | |
| 2,224,296 | | 12/1940 | Hoffman . | |
| 2,322,236 | | 6/1943 | Ingram . | |
| 2,429,984 | | 11/1947 | Berglund . | |
| 3,717,276 | | 2/1973 | Luczak et al. . | |
| 4,077,538 | | 3/1978 | Waterbury . | |
| 4,183,443 | | 1/1980 | DeParales et al. . | |
| 4,234,099 | | 11/1980 | Tarro . | |
| 4,339,053 | | 7/1982 | Tarro . | |
| 4,433,792 | * | 2/1984 | Mandel | 220/269 |
| 4,442,950 | | 4/1984 | Wilson . | |
| 4,463,866 | * | 8/1984 | Mandel | 220/269 |
| 4,489,018 | | 12/1984 | Ball . | |
| 4,541,541 | | 9/1985 | Hickman et al. . | |
| 4,580,692 | | 4/1986 | LaBarge et al. . | |
| 4,605,141 | * | 8/1986 | Won | 220/269 |
| 4,673,099 | | 6/1987 | Wells . | |
| 4,681,238 | | 7/1987 | Sanchez . | |
| 4,685,849 | | 8/1987 | LaBarge et al. . | |
| 4,711,363 | | 12/1987 | Marino . | |
| 4,711,372 | | 12/1987 | Gach . | |
| 4,720,022 | * | 1/1988 | Gomes | 220/269 |
| 4,735,336 | | 4/1988 | Buchner et al. . | |
| 4,747,511 | | 5/1988 | Dutt et al. . | |
| 4,792,054 | | 12/1988 | Weidman . | |
| 4,821,912 | | 4/1989 | Wells . | |
| 4,834,258 | * | 5/1989 | Root | 220/269 |
| 4,842,159 | | 6/1989 | Heidrich . | |
| 4,865,215 | | 9/1989 | Wells . | |
| 4,880,137 | * | 11/1989 | Wells | 220/269 |
| 5,080,249 | | 1/1992 | Shock . | |
| 5,143,248 | | 9/1992 | Sawatsky . | |
| 5,148,936 | | 9/1992 | DeGrow . | |
| 5,232,113 | | 8/1993 | Chen-Tsai et al. . | |
| 5,242,073 | | 9/1993 | Willis et al. . | |
| 5,251,770 | | 10/1993 | Bartley et al. . | |
| 5,285,924 | | 2/1994 | Morris . | |
| 5,363,978 | | 11/1994 | Molo . | |
| 5,443,175 | | 8/1995 | Kelly et al. . | |
| 5,555,993 | | 9/1996 | Borkowski et al. . | |
| 5,810,189 | | 9/1998 | Baker . | |
| 5,813,559 | * | 9/1998 | Cho | 220/258 |

FOREIGN PATENT DOCUMENTS

| | | |
|---|---|---|
| 1106799 | 8/1981 | (CA) . |
| WO 94/24006 | 10/1994 | (WO) . |

* cited by examiner

*Primary Examiner*—Stephen K. Cronin
(74) *Attorney, Agent, or Firm*—Tilton, Fallon, Lungmus & Chestnut

(57) ABSTRACT

A closure member for an open end of a container includes a main body segment secured to edge portions of the container and a flap segment pivotally mounted to the main body segment. The main body segment defines a discharge port through which fluid discharges from the container; and the flap segment moves between a first position in which is covers the discharge port and a second position away from the discharge port.

17 Claims, 8 Drawing Sheets

FIG. 1
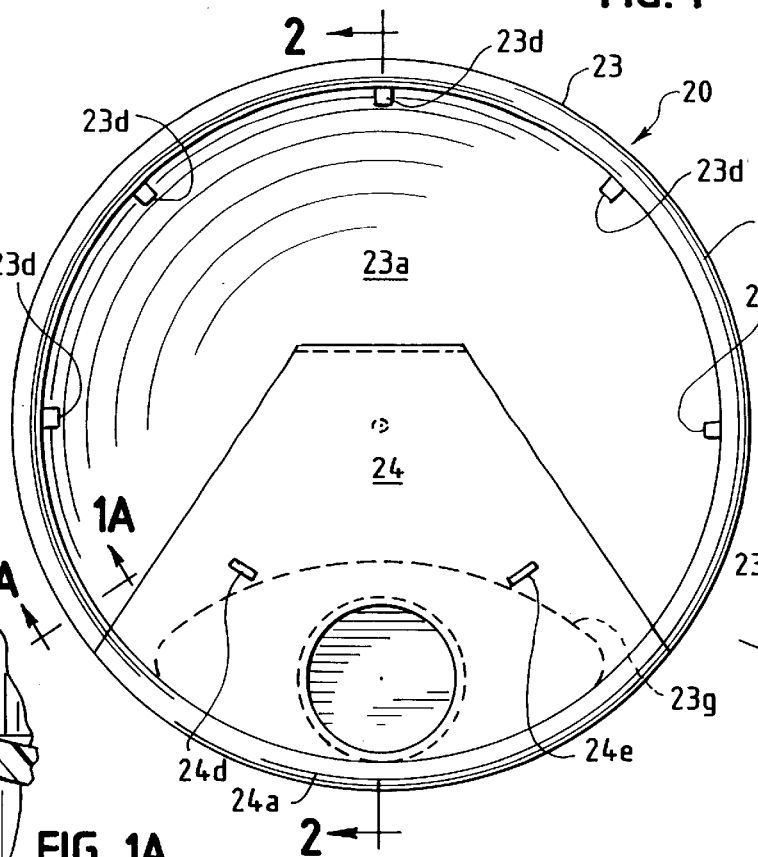
FIG. 1B
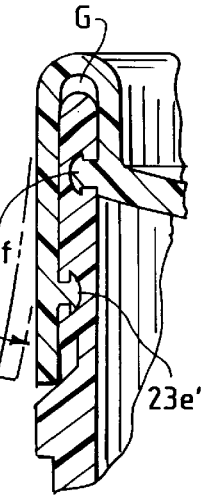
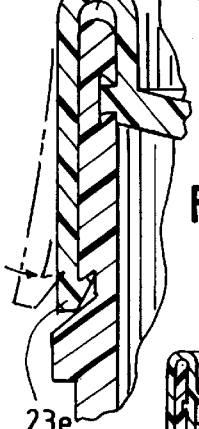
FIG. 1A
FIG. 2
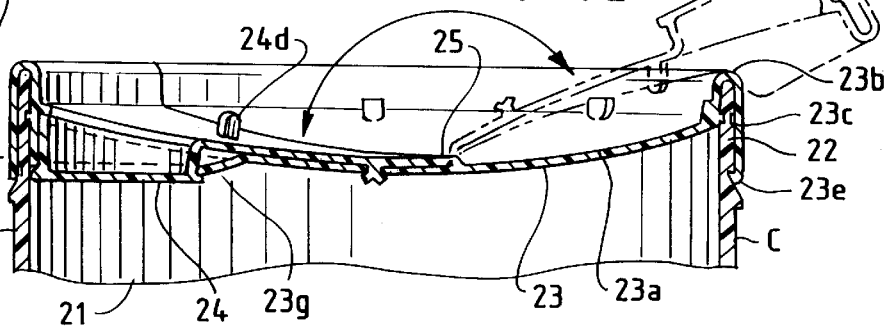
FIG. 3
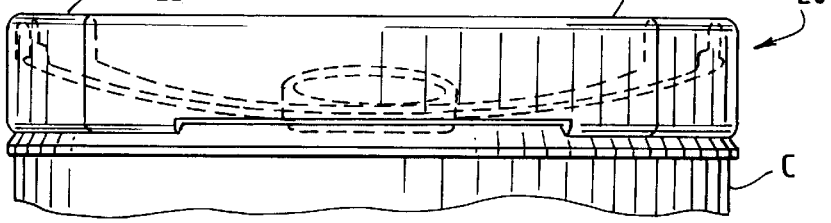

RESEALABLE CLOSURE FOR OPEN END OF CONTAINER

BACKGROUND OF THE INVENTION

1. Field of the Invention

The present invention relates to a closure member for an open end of a container, and more particularly to a closure member with a main body segment and a flap segment pivotally mounted to the main body segment for closing a discharge port of the main body segment.

2. Description of the Prior Art

The prior art includes a large number of containers for accommodating various types of goods, including beverages and other liquids. Such containers typically include a cylinder with an integrally formed bottom and an open top. They also include a closure that normally closes the open top and defines a sealed port through which one may discharge the contents of the container after breaking the seal. Some of the closures include resealable discharge ports that allow a user to repeatedly open and close the port.

A resealable closure should have a rugged, simple and inexpensive construction that allows repeated closing and opening while maintaining a tight seal even when the container holds pressurized fluid. It should allow easy opening; and it should simulate the local shape and lip feel of a drinking glass. A releasable closure should also keep the area that the lips contact clean by shielding it from environmental dirt or dust. It should further minimize slosh and facilitate pouring.

The prior art resealable containers of the general type described above fail to meet these criteria because of various inherent design characteristics. However, the closure member of the present invention does meet these criteria. It provides a simple and reliable construction that effectively closes a wide mouth enclosure or other similar container.

SUMMARY OF THE INVENTION

In accordance with the present invention, a closure member for closing an open end of a container includes a main body segment secured to edge portions of the container adjacent the open end and a flap segment pivotally mounted to the main body segment. The main body segment defines a discharge port through which fluid discharges from the container while the flap segment is moveable between a first position in which it covers the discharge port and extends over an edge portion of the container and a second position away from the port.

In one embodiment, the flap segment flips over as it moves between these two positions. In this embodiment, the flap segment includes a sleeve portion that extends into the discharge port and engages the main body segment portions adjacent the port to form a fluid-tight seal. In another embodiment, the flap segment slides over the main body segment as it moves from the first to the second position. In this embodiment, the flap segment lies rotatably mounted to the main body portion, and a sealing segment lies between the main body segment and the flap segment to assure a fluid-tight seal between these two segments.

BRIEF DESCRIPTION OF THE DRAWINGS

For a more complete understanding of this invention, one should now refer to the embodiment illustrated in greater detail in the accompanying drawings and described below by way of examples of the invention. In the drawings:

FIG. 1 is a plan view of one embodiment of the closure member of the present invention in place over a container;

FIG. 1A is an enlarged sectional view taken along line 1A—1A in FIG. 1;

FIG. 1B is the enlarged sectional view of FIG. 1A, showing a different sealing arrangement;

FIG. 2 is a sectional view taken along line 2—2 in FIG. 1;

FIG. 3 is a front elevation view of the closure member of FIG. 1 in place over a container;

Figure 4:
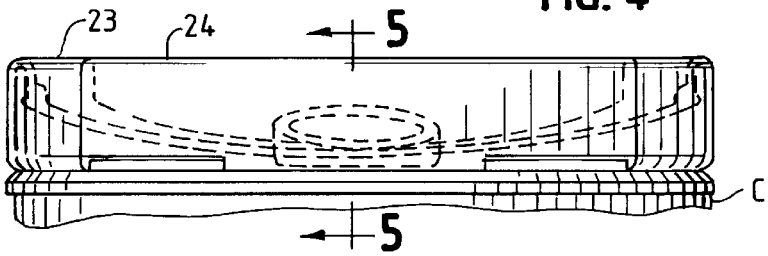
FIG. 4 is the front elevation view of FIG. 3, showing a modification of a flap segment that covers the discharge port of the closure member.

While the following disclosure describes the invention in connection with two embodiments and modifications of those embodiments, one should understand that the invention is not limited to these embodiments and modifications. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Turning now to the drawings and referring first to FIGS. 1 and 2, the closure member of the present invention shown generally at 20 closes an open top of a container C which normally contains pressurized fluid and includes a cylindrical body 21 with edge portions 22 and an integrally formed bottom (not shown). The container C may be a wide mouth plastic enclosure, a metal can, or any other enclosure made of any suitable material. The closure member 20 is a one-piece, integrally formed unit or component made out of a single or multi-layered plastic material such as polyolefin or polypropylene, PET, or any other suitable material that provides a gas barrier and has sufficient strength, flexibility and corrosion resistance. It includes a main body segment 23 and a flap segment 24 pivotally connected to the main body segment with a molded hinge (e.g., a living hinge) as shown at 25.

The main body segment 23 includes a smooth contoured or curved, generally horizontal portion 23*a* and a rim portion 23*b* which defines a cavity or slot 23*c* to receive the edge portions 22 of the container C. (Rib portions 23*d* stiffen the segment 23 to help maintain its structural integrity; and they serve as seats for machinery that connects the closure member to the container C.) The rim portion 23*b* extends over the edge portions 22 of the container C and latches onto the edge portions by having a barb-like distal end 23*e* extending into an outer annular groove 22*a* of the edge portions (See FIGS. 2 and 7). The rim portion 23*b* also includes a knob-like annular protuberance 23*f* that extends into an inner annular groove 22*b* of the edge portions 22. The distal end 23*e* and the protuberance 23*f* form a fluid-tight seal between the segment 23 and the container C.

FIG. 1A shows the initial position of the rim portion 23*b*(in phantom) before conventional machinery snaps the closure member into the secured position shown in solid lines in FIGS. 1A and 2. A gasket-like compound G applied to the distal end (or top end) of the edge portions 22 of the container C in combination with the barb-like end 23*e* and the knob-like protuberance 23*f* provide a secure fluid tight seal between the main body segment 23 and the container C. (A modification of this arrangement may include a knob-like protuberance 23*e'* instead of a barb-like latch anywhere along the outside part of the rim portion 23*b*, See FIG. 1B.) Connecting the closure member to the container C includes the step of forcing the rim portion of the closure member into locking engagement (as shown in FIGS. 1A and 1B), using, for example, high compressive forces generated between variations of the seaming chucks and rollers normally used in double-seaming metal cans and ends.

Figure 5:
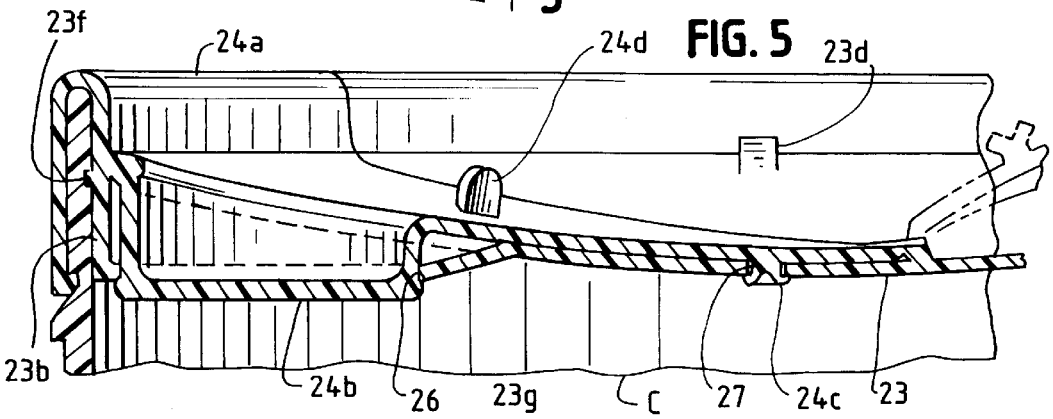
FIG. 5 is an enlarged sectional view of the left hand portion of FIG. 2, showing the flap segment in a first, closed position.
Figure 6:
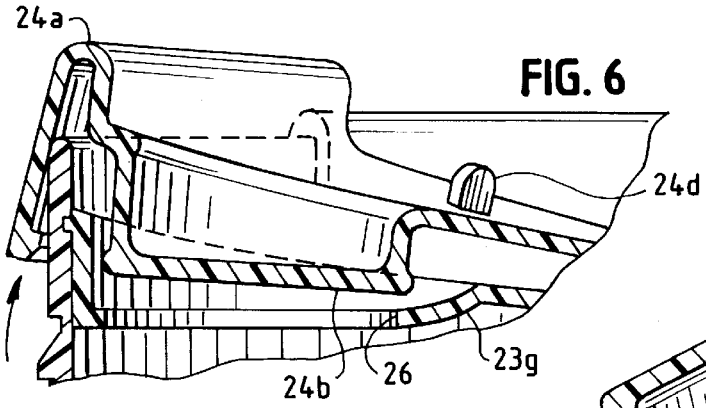
FIG. 6 is an enlarged sectional view of the left hand portion of FIG. 5, showing a part of the flap segment as it moves out of the first position.
Figure 7:
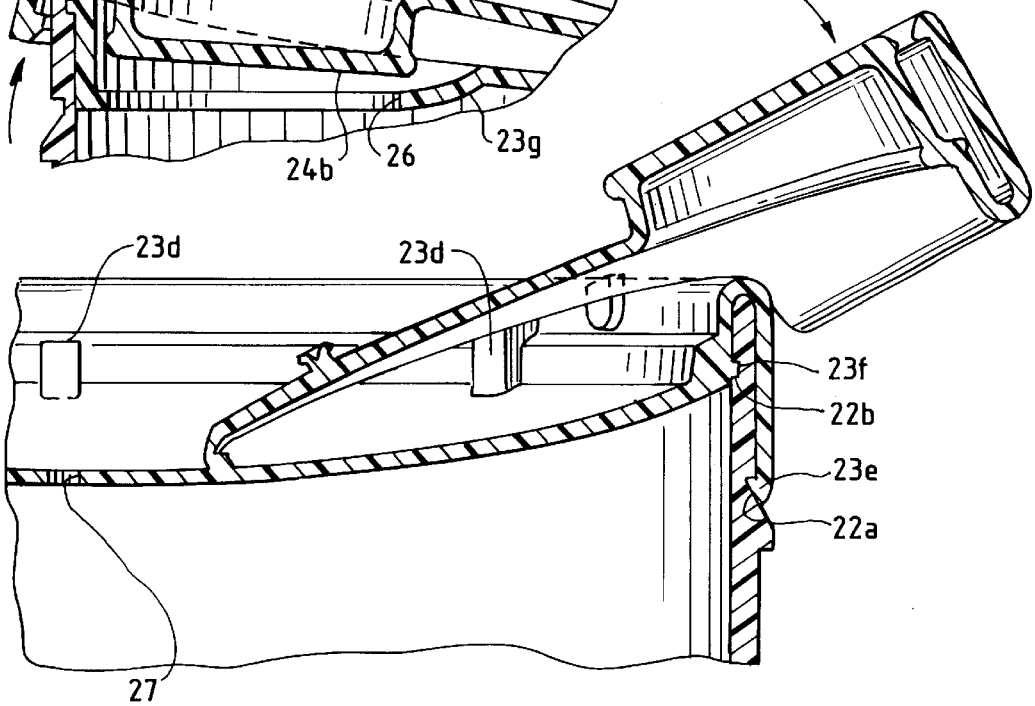
FIG. 7 is an enlarged sectional view of the right hand portion of FIG. 2, showing the flap segment in a second, open position.

The main body segment 23 defines two openings—a discharge port 26 and a vent 27 (See FIGS. 5–7). The discharge port 26 lies proximate the edge portions 22 in a curved, elliptic depression 23*g* of the horizontal portion 23*a*. Liquid disposed in the container C discharges through this port 26, allowing an individual to drink from the container. The depression 23*g* provides a large drinking surface area to facilitate drinking; and the vent opening 27 allows air to enter the container C as the contents discharge through the port 26, providing easy discharge of liquid from the port 26. (The vent opening 27 lies proximate the middle of the portion 23*a* as shown in FIG. 2.)

If the port 26 had an area equal to that of the depression 23*g*, the flap segment 24 would be subjected to too high an opening force to be contained by the combination of the barb-like latch 23*e* and the mechanical interference between the sleeve 24*b* and the sides of the port 26. Conversely, if the closure member did not include a depression 23*g*, the drinking sensation from the small port 26 would be unsatisfactory. Moreover, if the closure member did not include a vent 27, the flow through the port 26 would be too slow and non-uniform in time. By way of a specific example, the closure member 20 includes an area for the port 26 that is less than 0.6 square inches and preferably between 0.1 and 0.35 square inches.

The flap segment 24 generally has the shape of a truncated pie section; and it includes a rim portion 24*a* with a shape similar to that of the rim portion 23*b* of the main body segment 23. This segment 24 also includes a closed sleeve portion 24*b* that normally closes the discharge port 26 when the segment 24 lies in a first position shown in FIGS. 2 and 5 and a plug portion 24*c* that normally closes the vent 27 when the segment 24 lies in the first position. The distal ends of the sleeve portion 24*b* and the plug portion 24*c* spread outwardly to better engage the portions of the main body segment 23 that lie adjacent the port 26 and the vent 27 and help seal the port and vent and prevent pressurized contents from forcing open the port 26. The sleeve 24*b*(and accordingly the discharge port 26) is small enough to overcome the pressure exerted by the contents of the container C but large enough to allow easy discharge of those contents. As stated above, the combination of the port 26, the depression 23*g* and the vent 27 provide easy discharge and drinking of the contents of the container C.

The flap segment 24 is moveable between two positions—a first position shown in FIGS. 2 and 5 and a second position shown in FIG. 7. In the first position, the segment 24 closes the port 26 and the vent 27, as described above. In the second position, the segment 24 flips over; and two projections 24*d* and 24*e* of the segment 24 engage the inside surface of the rim portion 23*b* of the main body segment 23 to releasably secure the flap segment 24 in the second position shown in FIG. 7. To move the flap segment 24 from the first to the second position, one must first disengage the rim portion 24*a* from the edge portion 22 of the container C. As shown in FIG. 3, the middle of this rim portion 24*a* has its barb-like end, the end that extends into the outer groove 22*a*, cut away to allow easy disengagement. (The modification shown in FIG. 4 has the ends of the distal barb-like end cut away.) In addition, this closure member 20 may include a bridging portion between the main body segment 23 and the flap segment 24. This bridging portion is a tampering evidence feature that would break the first time that someone opened the flap segment.

Another embodiment 120 shown in FIGS. 8–13 similarly includes a main body segment 123 and a flap segment 124. However, in this embodiment, the flap segment 124 lies rotatably connected to the main body segment 123 as at 125. The pivot at 125 comprises a projecting, arcuate portion 124*f* of the flap segment 124 and a channel or trough 123*h* of the main body segment 123 that receives the portion 124*f* and guides it along a circular path. The trough 123*h* slopes slightly so that the flap segment may exert a sealing force (directed inwardly of the container C) when the flap segment moves from the second to the first position. The flap segment 124 rotates from a first position shown in FIG. 8, counter-clockwise to a second position shown in FIG. 13, away from a discharge port 126 of the main body segment 123. In the first position, the flap segment 124 covers the port 126; and a continuous sealing liner 127 disposed in a groove 124*g* and secured to the segment 124 forms a fluid-tight seal around the port. The liner 127 is a resilient member made out of rubber or any other suitable material. Also, in this embodiment, the port 126 is larger than the port 26.

Figure 8:
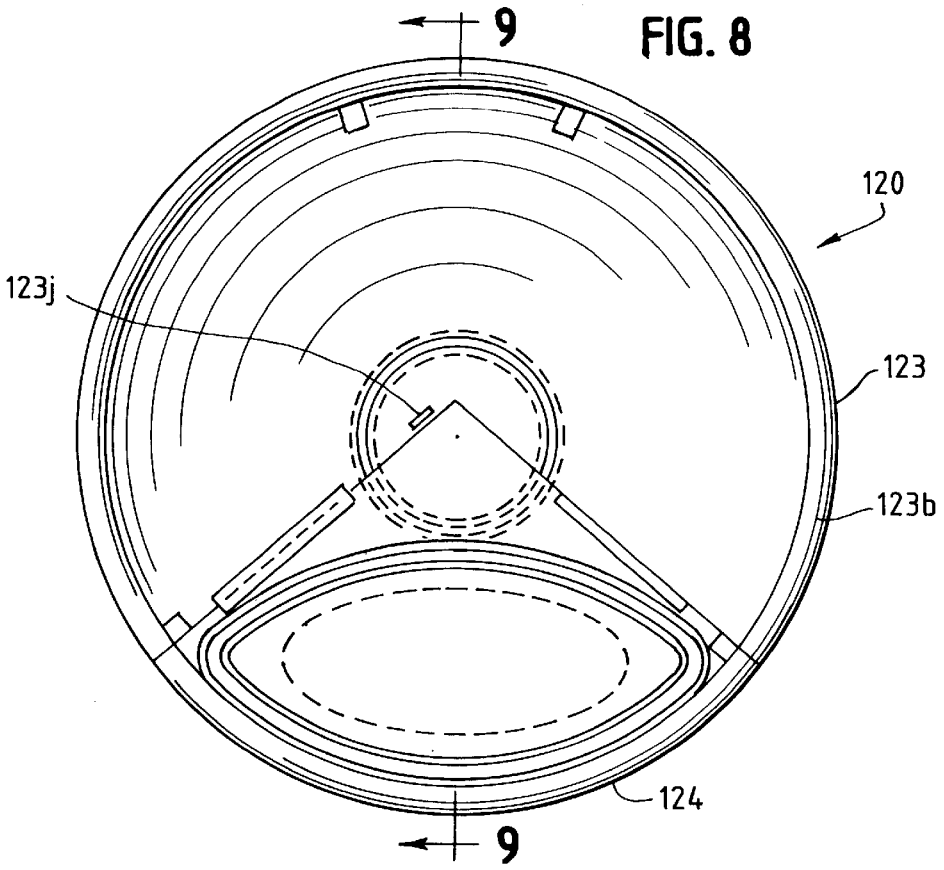
FIG. 8 is a plan view of another embodiment of the closure member of the present invention in place over a container.
Figure 9:
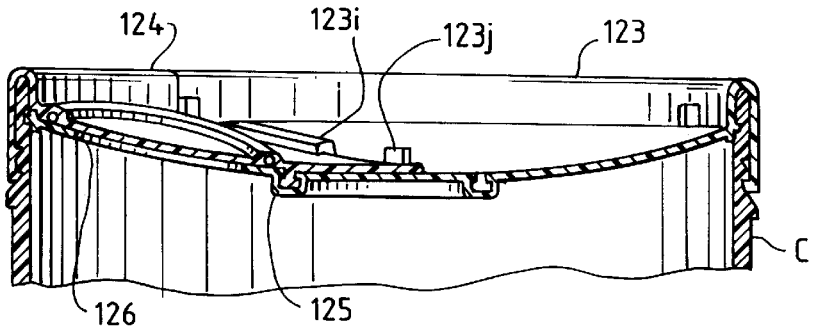
FIG. 9 is a sectional view taken along line 9—9 in FIG. 8.
Figure 10:
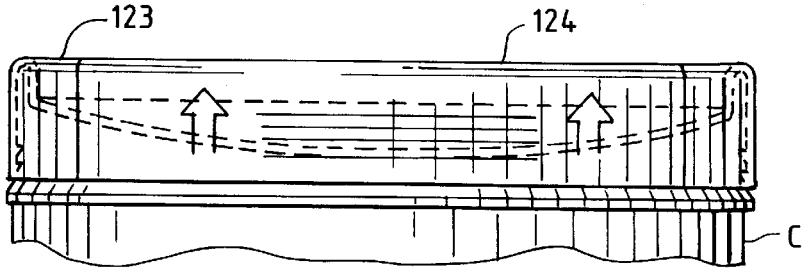
FIG. 10 is a front elevation view of the closure member of FIG. 8 in place over a container.
Figure 13:
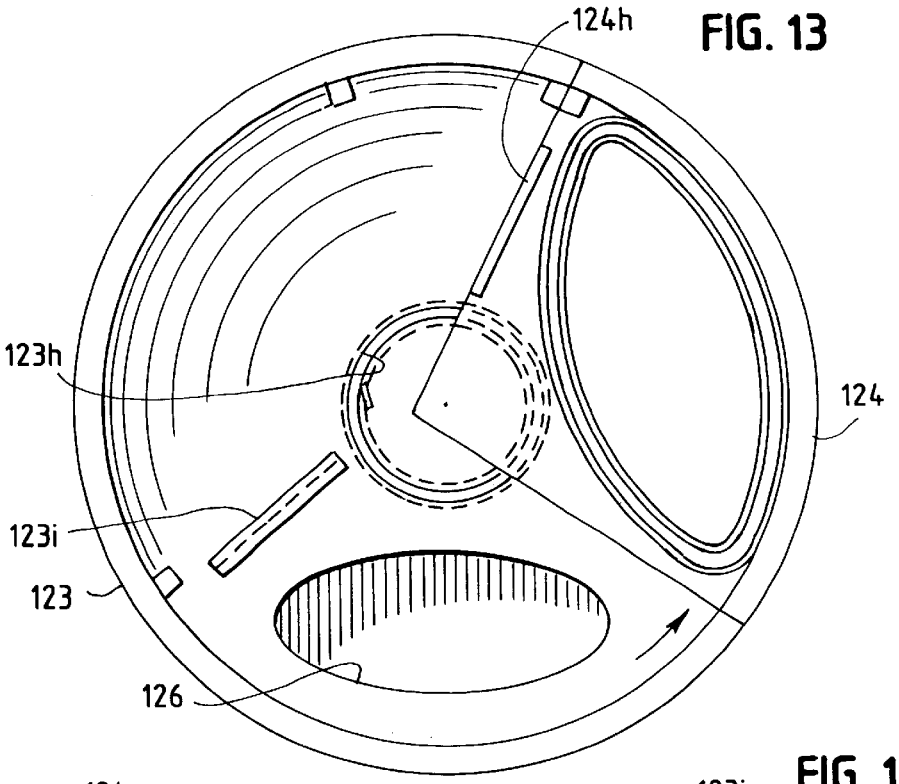
FIG. 13 is a plan view of the embodiment of FIG. 8, showing the flap segment as it moves away from the first position of FIG. 8 to a second position where it does not obstruct the discharge port of the closure member.

The main body segment 123 includes a stop portion 123*i* that engages a side of the flap segment 124 to stop further clockwise rotation of the segment 124 beyond the position shown in FIG. 8 and exert a force inwardly of the container C that helps maintain the seal between the flap segment and the main body segment. It also includes a breakable projection 123*j* which the flap segment 124 breaks but does not detach the first time that the segment 124 rotates from the first to the second position. (This feature shows any tampering with the closure member 120.) The segment 124 includes a handle portion 124*h* used to drive the segment between the first and the second positions and to add rigidity to the segment 124.

Figure 11:
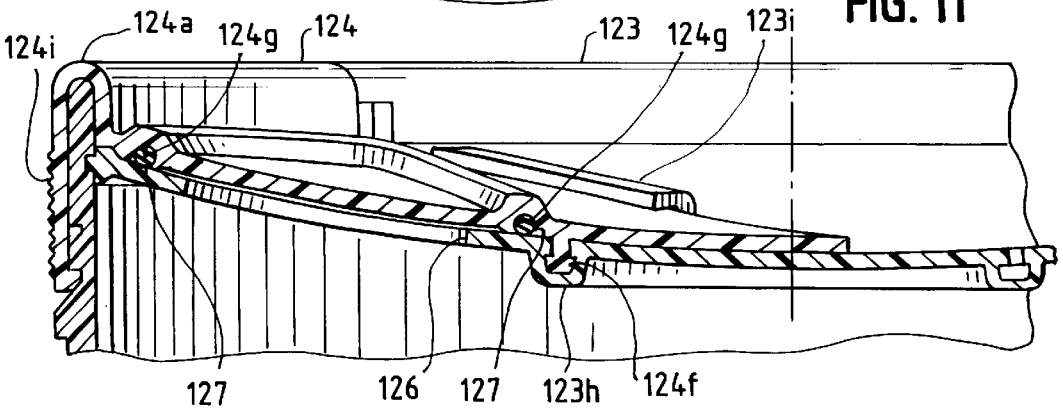
FIG. 11 is an enlarged sectional view of the left hand portion of FIG. 9.
Figure 12:
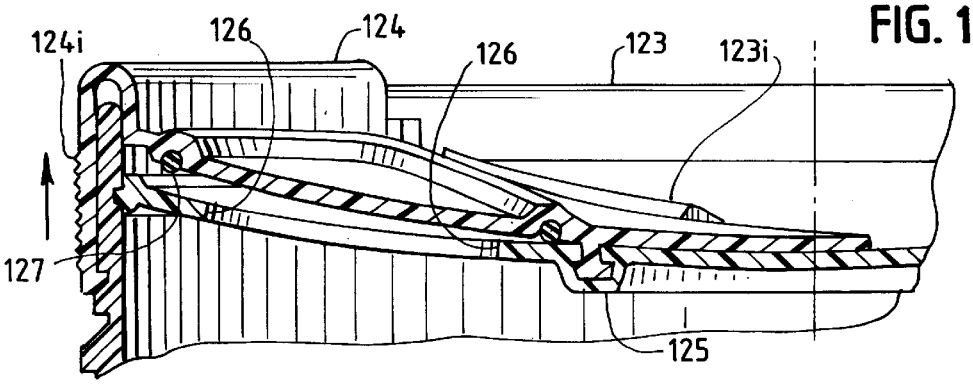
FIG. 12 is the enlarged sectional view of FIG. 11, showing the flap segment raised a predetermined distance above its first, closed position so that it can slide to the second position.
Figure 14:
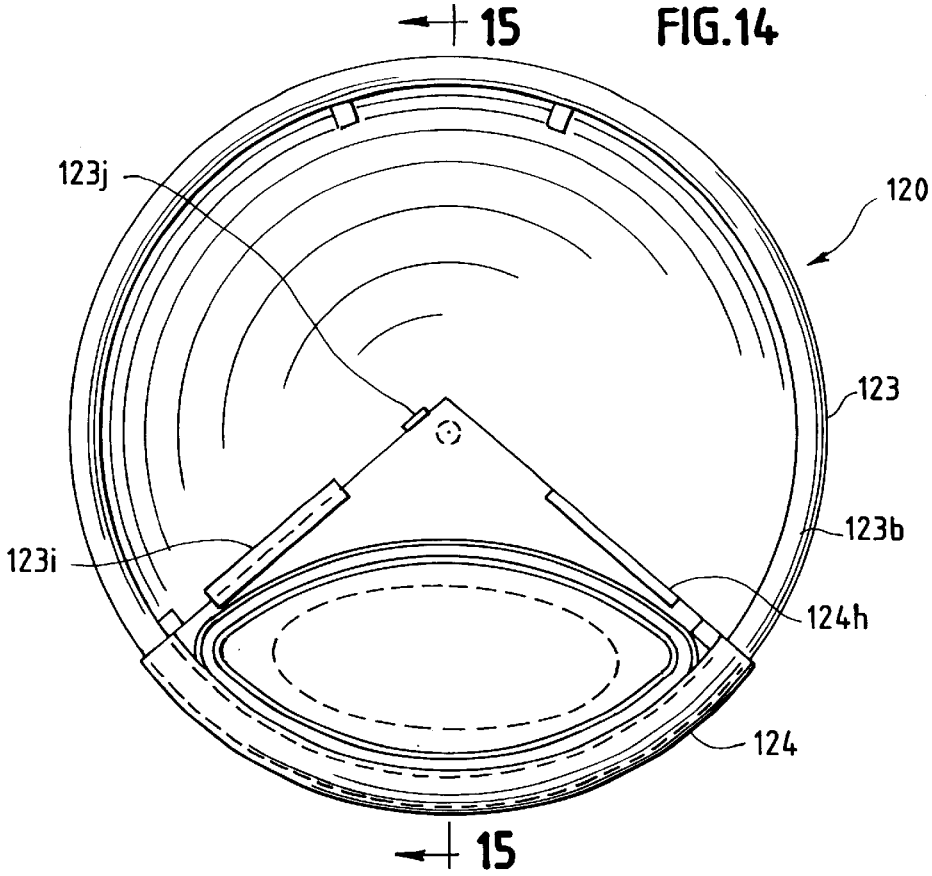
FIG. 14 is a plan view of a modified form of the embodiment of FIG. 8.
Figure 15:
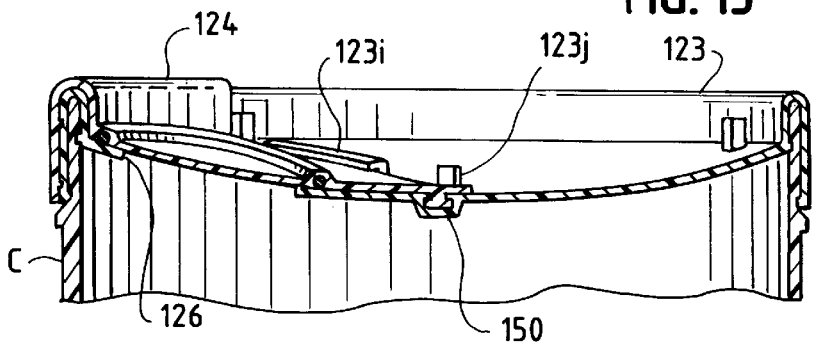
FIG. 15 is a sectional view taken along line 15—15 of FIG. 14.
Figure 16:
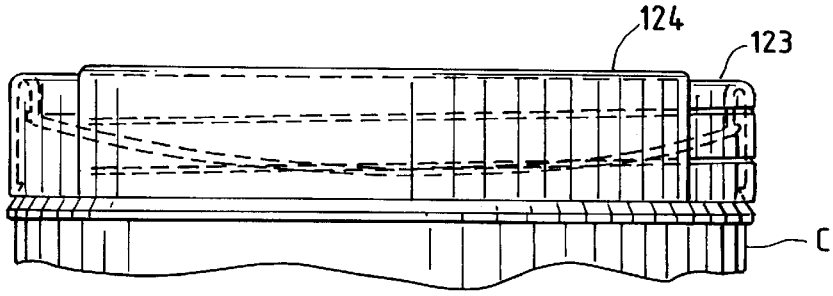
FIG. 16 is a front elevation view of the closure member of FIG. 14 in place over a container.
Figure 18:
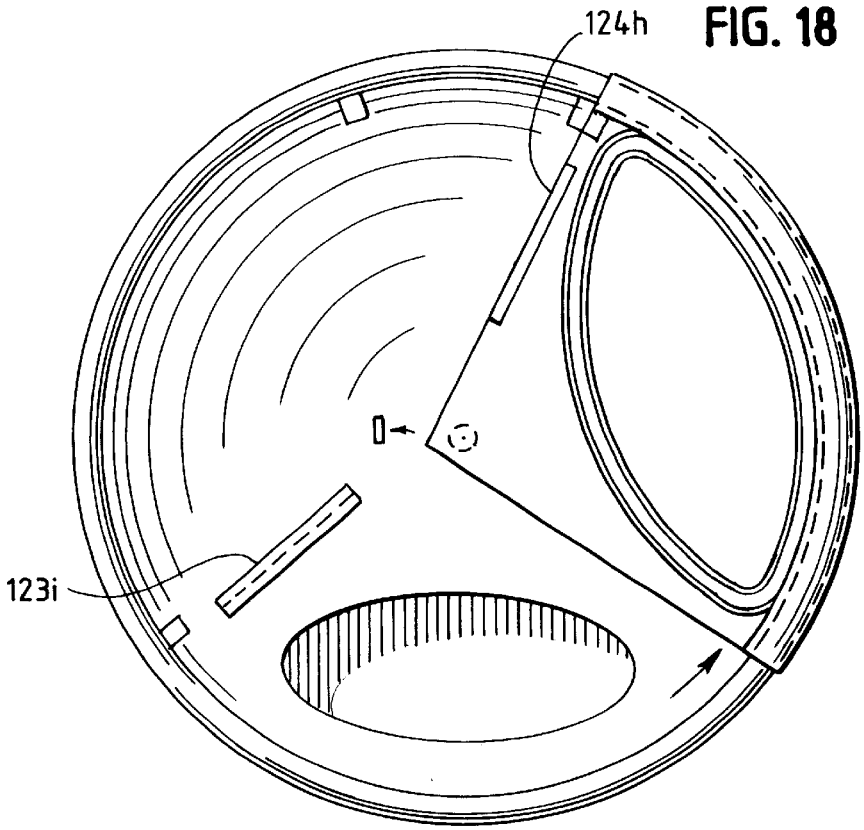
FIG. 18 is a plan view of the closure of FIG. 14, showing the flap segment as it moves away from the first position of FIG. 14 to a second position where it does not obstruct the discharge port of the closure member.
Figure 17:
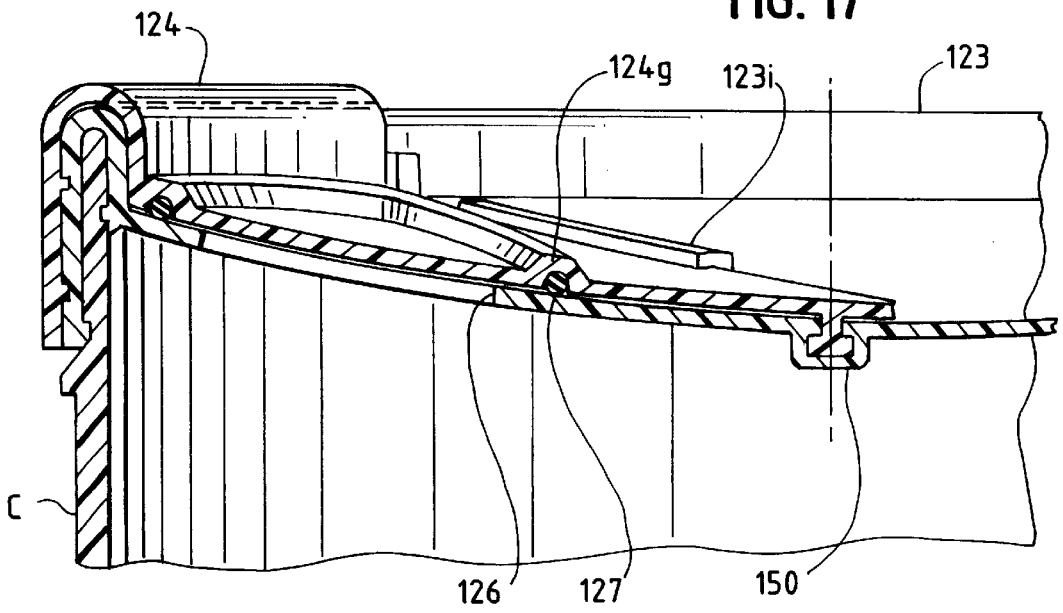
FIG. 17 is an enlarged sectional view of the left hand portion of FIG. 15.
Figure 19:
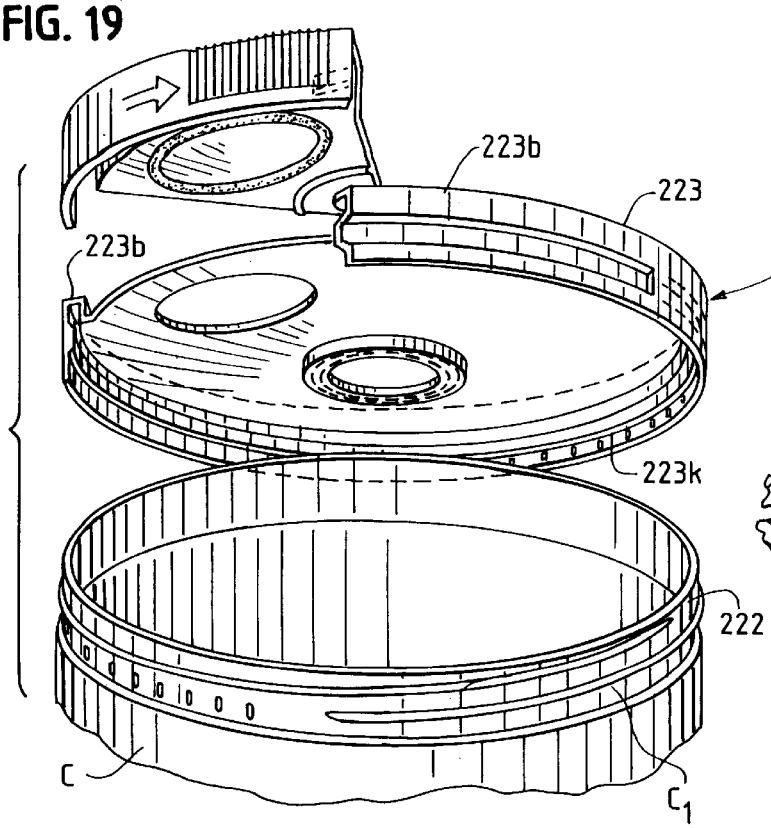
FIG. 19 is an exploded perspective view of modified main body and flap segments, including alternative securing means that threadably secure the closure member to a container.

To move the flap segment 124 from the first to the second position, one must first lift the segment from the locked or lowered arrangement shown in FIG. 11 to an unlocked or raised arrangement shown in FIG. 12. In the lowered arrangement, the flap segment 124 lies flush with the main body segment 123. But in the raised arrangement the flap segment can override the main body segment 123 to move between the first and second positions. (A grooved surface 124*i* on an outward face of a rim portion 124*a* of the flap segment 124 facilitates grasping of the segment 124 to place it in the raised arrangement.)

Referring to FIGS. 14–18, a modification of the embodiment shown in FIGS. 8–13 includes a main body segment 123 with a rim portion 123*b* that has the same shape around the entire circumference of the container C. (In the first embodiment, FIGS. 1–7, and in the second embodiment, FIGS. 8–13, the rim portion that extends over the edge portions of the container has a gap that the flap segment fills when it lies in the first position.) In addition, the connection between the flap and the main body segments is a single pivot 150 about the center of the closure member and the container C. This pivot includes a knob portion of the flap segment and a cooperating well of the main body segment.

The modification of FIGS. 14–18 includes grooves in the rim portion of the main body segment and cooperating threads on the inside of the rim portion of the flap segment. (Although the FIGS. 8–13 do not show these features, the embodiment of those figures may also include them.) This threading forces the flap segment inwardly of the container C as the flap segment moves from the second to the first position. This action provides a better seal between the main body segment and the flap segment. It supplements the sealing force provided by the portion 123*i*.

Figure 20A:
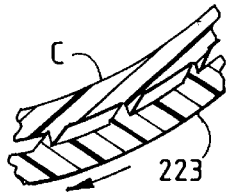
FIG. 20A is a sectional view taken along line 20A—20A in FIG. 20.
Figure 21:
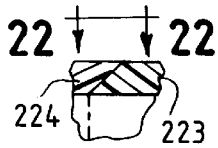
FIG. 21 is a sectional view taken along line 21—21 in FIG. 20.
Figure 20:
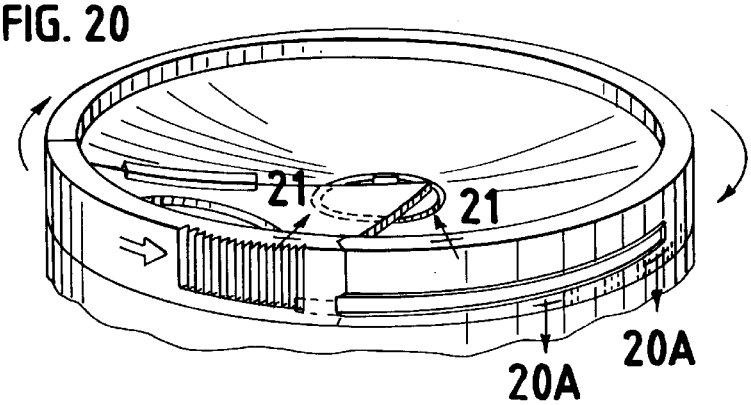
FIG. 20 is a perspective view of the modification of FIG. 19.
Figure 23:
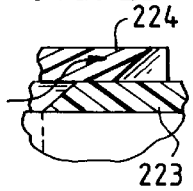
FIG. 23 is the sectional view of FIG. 21 with the flap segment disposed away from the discharge opening.
Figure 22:
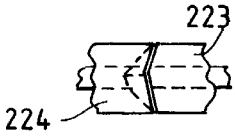
FIG. 22 is an elevational view taken along line 22—22 in FIG. 21.

In the embodiments and modifications described above "snap-on" type procedures make the connection between the closure member and the container C. "Snap-on" type procedures include conventional double seam-like and push on methods. Alternatively, the closure member 220 may thread onto the container C. (See FIGS. 19–25.) In this alternative, the main body segment 223 includes a rim portion 223*b* with threading 223*k* formed on the container engaging face of the rim portion. The container C has cooperating grooves $C_1$ formed into the outer face of edge portions 222. The grooves $C_1$ and threading 223*k* include teeth (See FIG. 20A) that allow rotation of the closure member only in one direction, e.g., the clockwise direction. Once in place on the container C, the main body segment 223 cannot rotate in the opposite direction to disconnect from the container C because the teeth stop such reverse rotation.

Figure 25:
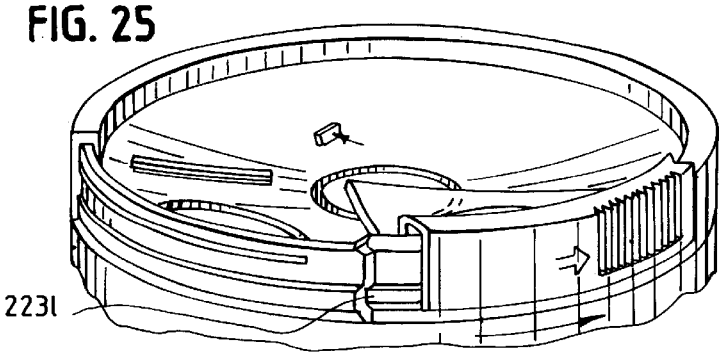
FIG. 25 is the perspective view of FIG. 20 with the flap segment disposed in the second position and with a portion of the main body segment cut away.
Figure 24:
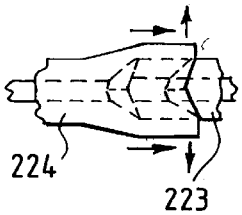
FIG. 24 is the elevational view of FIG. 22 with the flap segment disposed away from the discharge opening.
Figure 26:
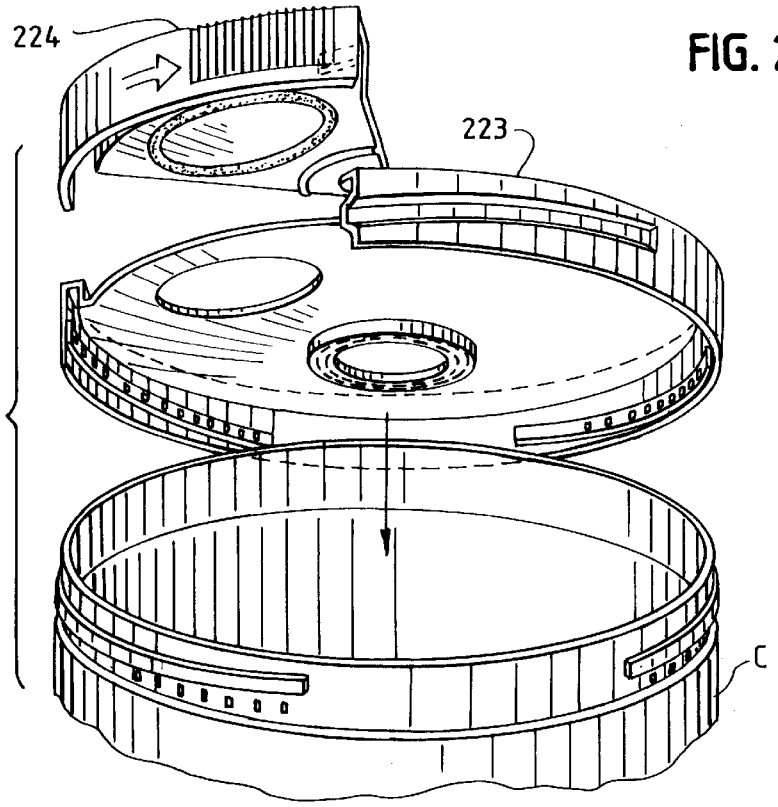
FIG. 26 is an exploded perspective view of a further modification of the main body and flap segments, including securing means for securing the closure member to a container.
Figure 27:
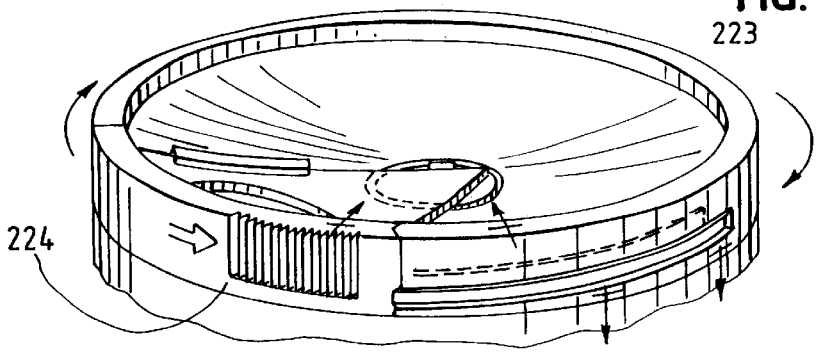
FIG. 27 is a perspective view of the closure member shown in FIG. 26.
Figure 28:
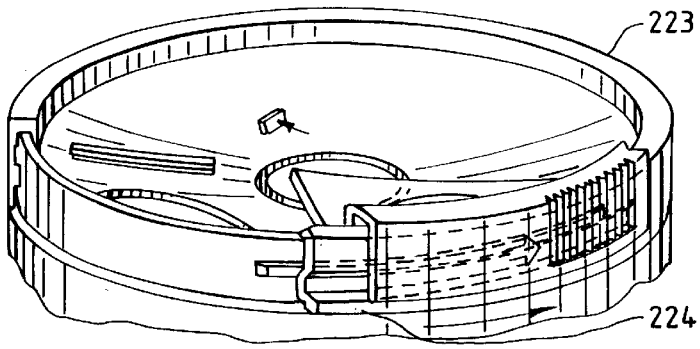
FIG. 28 is the perspective view of FIG. 27, showing the flap segment in the second, open position.

However, the flap segment 224 of this alternative may rotate between a first, closed position (See FIG. 20) and a second, open position (See FIG. 25). (This flap segment 224 does not include the reverse anti-rotation feature used to secure the main body segment 223.) A groove 223*l* formed into the outside face of the rim portion 223*b* facilitates this rotation and allows the flap segment 224 to slide over the main body segment 223 (See FIGS. 21–24). FIGS. 26–28 show a further modification, in which discontinuous thread segments replace the continuous, helical thread and groove features of the alternative in FIGS. 19–25. In this "push and twist" alternative one may start the twisting in any one of a number of positions and the discontinuous thread segments of the main body segment engage those of the container to secure the closure member and the container together. The stopping teeth of FIG. 20A lie on the side of the thread segments.

While the above description and the drawings disclose and illustrate two embodiments and various modifications, one should understand, of course, that the invention is not limited to these embodiments and modifications. Those skilled in the art to which the invention pertains may make other modifications and other embodiments employing the principles of this invention, particularly upon considering the foregoing teachings. For example, one may use the threaded connection of FIGS. 19–25 or FIGS. 26–18 with the first embodiment shown in FIGS. 1–7. Therefore, by the appended claims, the applicants intend to cover any modifications and other embodiments as incorporate those features which constitute the essential features of this invention.

What is claimed is:

1. A closure member for closing an open end of a container, said closure member comprising: a main body segment securable to edge portions of the container and defining a discharge port through which fluid may discharge from the container, said discharge port being selectively openable and closable by means of a flap segment slidingly mounted to the main body segment at a portion away from the periphery of the main body segment; said flap segment being moveable between a sealed position in which it sealingly covers the discharge port and an unsealed position away from the discharge port; and a resilient sealing segment disposed between the main body segment and the flap segment adjacent the discharge port; said sealing segment including a continuous liner, and said closure member including integral means for translating sliding motion of said flap segment into a sealing force directed toward said discharge port, whereby sliding of said flap segment from said unsealed position to said sealed position results in said flap segment sealingly engaging said discharge port.

2. The member of claim 1, wherein the discharge port lies proximate the periphery of the main body segment and the flap segment is slidingly mounted to a middle portion of the main body segment by means of an integral projection of said flap segment.

3. The member of claim 1, wherein the flap segment unseals said discharge port and slides over the main body segment as it slides from the sealed position to the unsealed position.

4. The member of claim 1, wherein the integral means for translating sliding motion of said flap segment into a sealing force directed toward said discharge port includes a catch portion provided on said main body segment that receives an edge portion of the flap segment to releasably secure the flap segment in the sealed position.

5. The member of claim 1, wherein the main body segment includes a breakable means for initially impeding said flap segment from sliding from the sealed to the unsealed position.

6. A closure member for closing an open end of a container, said closure member comprising: a main body segment secured to edge portions of the container and defining a discharge port through which fluid may discharge from the container; a flap segment pivotally mounted to the main body segment at a portion away from the periphery of the main body segment; and a resilient sealing segment including a continuous ring disposed between the main body segment and the flap segment adjacent the discharge port; said flap segment being moveable between a first position in which it covers the discharge port and extends over an edge portion of the container and a second position away from the port; said flap segment sliding over the main body segment as it moves from the first to the second position.

7. The member of claim 6, wherein the discharge port lies proximate the container edge portion over which the flap segment extends and the flap segment is pivotally mounted to a middle portion of the main body segment.

8. The member of claim 6, wherein the main body segment includes a catch portion that receives an edge portion of the flap segment to releasably secure the flap segment in the first position.

9. The member of claim 6, wherein the main body portion define a breakable protuberance that an edge portion of the flap segment breaks as it moves from the first to the second position.

10. In combination with a container with an open end, a closure member for normally closing the open end, said closure member comprising: a main body segment securable to edge portions of the container and defining a selectively openable and closeable discharge port through which fluid may discharge from the container said discharge port being selectively openable and closable by means of a flap segment slidingly mounted to the main body segment at a portion away from the periphery of the main body segment; said flap segment being moveable between a sealed position in which it sealingly covers the discharge port and an unsealed position away from the discharge port; a resilient sealing segment disposed between the main body segment and the flap segment adjacent the discharge port; and means for translating sliding motion of said flap segment into a sealing force on the flap segment directed toward said discharge port, whereby sliding of said flap segment from said unsealed position to said sealed position results in said flap segment sealingly engaging said discharge port.

11. The combination of claim 10, wherein the closure member and the container include cooperating means for securing one with the other.

12. The combination of claim 10, wherein the main body segment and the flap segment define a ring with a slot for receiving edge portions of the container.

13. The combination of claim 12, wherein the slot has an annular configuration.

14. A closure member for closing an open end of a container, said closure member comprising: a main body segment secured to edge portions of the container and defining a discharge port through which fluid may discharge from the container; a flap segment pivotally mounted to the main body segment at a portion away from the periphery of the main body segment; said flap segment being moveable between a first position in which it covers the discharge port and extends over an edge portion of the container and a second position away from the discharge port; and a resilient sealing segment disposed between the main body segment and the flap segment adjacent the discharge port; said sealing segment including a continuous ring.

15. A closure member for closing an open end of a container, said closure member comprising: a main body segment securable to edge portions of the container and defining a selectively openable and closable discharge port through which fluid may discharge from the container; said discharge port being selectively openable and closable by means of a flap segment slidingly mounted to the main body segment at a portion away from the periphery of the main body segment by means of an integral projection of the flap segment; said flap segment being movable between a sealed position in which it sealingly covers the discharge port and an unsealed position away from the discharge port; the main body segment including means for translating sliding motion of said flap segment into a sealing force on the flap segment directed toward the discharge port, whereby sliding of said flap segment from said unsealed position to said sealed position results in said flap segment sealingly engaging the discharge port.

16. A closure member for closing an open end of a container, said closure member comprising: a main body segment securable to edge portions of the container and defining a selectively openable and closable discharge port through which fluid may discharge from the container said discharge port being selectively openable and closable by means of a flap segment slidingly mounted to the main body segment at a portion away from the periphery of the main body segment; said flap segment being slideable between a sealed position in which it sealingly covers the discharge port and an unsealed position away from the discharge port; and means for slidingly mounting the flap segment to the closure member, breakable means for initially impeding sliding of said flap segment away from the sealed position, and said closure member including integral means for translating sliding motion of said flap segment into a sealing force directed toward said discharge port, whereby sliding of said flap segment from said unsealed position to said sealed position results in said flap segment sealingly engaging said discharge port.

17. A closure member for closing an open end of a container, said closure member comprising: a main body segment securable to edge portions of the container and defining a selectively openable and closable discharge port through which fluid may discharge from the container, said discharge port being selectively openable and closable by means of a flap segment slidingly mounted to the main body segment at a portion away from the periphery of the main body segment by means of a projection of said flap segment slidingly received in an opening in said main body segment proximate said discharge port; said flap segment being slideable between an initial sealed position in which it sealingly covers the discharge port and a subsequent unsealed position away from the discharge port; and a resilient sealing segment disposed between the main body segment and the flap segment adjacent the discharge port; said sealing segment including a continuous liner; the main body segment including means for translating sliding motion of said flap segment into a sealing force on the flap segment directed toward the discharge port, whereby sliding of said flap segment from said unsealed position to said sealed position results in said flap segment sealingly engaging the discharge port.

* * * * *